US005874805A

United States Patent [19]

Kavanagh

[11] Patent Number: 5,874,805

[45] Date of Patent: Feb. 23, 1999

[54] ELECTRODE STRUCTURE INCLUDING A ROD COMPRISING REFRACTORY METAL AND HAVING A GREATER THERMAL CONDUCTIVITY MATERIAL

[75] Inventor: Martin Kavanagh, Lancashire, England

[73] Assignee: Digital Projection Limited, Manchester, England

[21] Appl. No.: 750,125

[22] PCT Filed: Jun. 30, 1995

[86] PCT No.: PCT/GB95/01529

§ 371 Date: Feb. 24, 1997

§ 102(e) Date: Feb. 24, 1997

[87] PCT Pub. No.: WO96/02062

PCT Pub. Date: Jan. 25, 1996

[30] Foreign Application Priority Data

Jul. 11, 1994 [GB] United Kingdom ..... 9413973

[51] Int. Cl.[6] ..... H01J 17/04; H01J 61/04

[52] U.S. Cl. ..... 313/631; 313/326; 313/632; 313/311; 313/346 R; 313/346 DC

[58] Field of Search ..... 313/326, 346 R, 313/346 DC, 352, 630, 632, 633, 631, 311

[56] References Cited

U.S. PATENT DOCUMENTS

| | | | |
|---|---|---|---|
| 3,248,591 | 4/1966 | Arndt | 313/217 |
| 3,849,690 | 11/1974 | Cosco et al. | 313/217 |
| 3,911,309 | 10/1975 | Kummel et al. | 313/346 R |
| 3,916,241 | 10/1975 | Pollard | 313/184 |
| 4,097,762 | 6/1978 | Hilton et al. | 313/218 |
| 4,229,873 | 10/1980 | Bykhovsky et al. | 313/346 DC |
| 4,275,123 | 6/1981 | Buxbaum et al. | 313/346 R |
| 4,487,589 | 12/1984 | Mishra et al. | 445/51 |
| 4,574,219 | 3/1986 | Davenport et al. | 315/49 |
| 5,422,539 | 6/1995 | Chodora | 313/631 |

FOREIGN PATENT DOCUMENTS

| | | |
|---|---|---|
| 0272687 A2 | 6/1988 | European Pat. Off. . |
| 4229317 A1 | 3/1994 | Germany . |
| 659765 | 10/1951 | United Kingdom . |
| 1007526 | 10/1965 | United Kingdom . |

OTHER PUBLICATIONS

Abstract of Japanese Patent Publication No. JP 58 034556, published Mar. 1, 1983, from *Patent Abstract of Japan*, vol. 7, No. 115, 1 page (1983).

*Primary Examiner*—Jay M. Patidar
*Attorney, Agent, or Firm*—Schwegman, Lundberg, Woessner & Kluth, P.A.

[57] ABSTRACT

An electrode structure for use in a sealed arc lamp is described. The electrode structure includes a tungsten containing rod surrounded by a block of sintered tungsten containing powder. The block may be impregnated with a thermally conductive material such as copper, silver or braze, and may have a high thermal emissivity surface.

15 Claims, 3 Drawing Sheets

ELECTRODE STRUCTURE INCLUDING A ROD COMPRISING REFRACTORY METAL AND HAVING A GREATER THERMAL CONDUCTIVITY MATERIAL

BACKGROUND OF THE INVENTION

1. Field of the Invention

This invention relates to electrode structures. The invention has particular, although not exclusive, relevance to electrode structures for use in sealed arc lamps which incorporate an ionizable gas (for example xenon), to enable an arc to be established between two electrode structures in the lamp.

2. Description of the Related Art

As a result of the high temperatures involved in the formation of an arc, sealed arc lamps generally use tungsten electrodes. Such electrodes often contain small amounts of additional elements in order to modify the properties of the electrodes. For example by the addition of thorium oxide, the work function of the electrode may be reduced thus promoting arc ignition in the lamp. Normally the electrode is machined by diamond grinding from a solid tungsten rod or bar, the surface of the electrode often being profiled so as to increase the effective surface area of the electrode thereby facilitating radiative cooling of the electrode. However, this machining is expensive and, in the case where thorium oxide has been added to reduce the work function, is a hazardous procedure.

It is an object of the present invention to provide an electrode structure wherein these problems are at least alleviated, and in which the effective surface area of the electrode structure may be increased over that which has previously been possible.

SUMMARY OF THE INVENTION

According to a first aspect of the present invention there is provided a method of forming a structure comprising inserting a high melting point material rod into a press tool, pressing a block of powder around said rod, sintering the structure to create a fused integral structure, and forming the structure into the required shape.

Where the structure is an electrode, the powder will suitably be electrically conductive. The electrically conductive powder suitably comprises tungsten or a tungsten containing mixture.

The forming of the structure into the required shape may be produced by the shape of the press tool. Alternatively or additionally, the forming may be performed by machining prior to sintering while the powder is friable.

According to a second aspect of the present invention there is provided an electrode structure comprising a high melting point material rod, part of which forms the arc seat of the electrode, the rod being at least partially surrounded by a sintered electrically conductive powder block.

In a preferred embodiment the powder is impregnated with a heat conductive material. Suitable heat conductive materials are copper, silver or braze alloys.

BRIEF DESCRIPTION OF THE DRAWINGS

A number of embodiments of electrode structures in accordance with the invention will now be described by way of example only, with reference to the accompanying figures in which.

DESCRIPTION OF THE PREFERRED EMBODIMENTS

Figure 1:
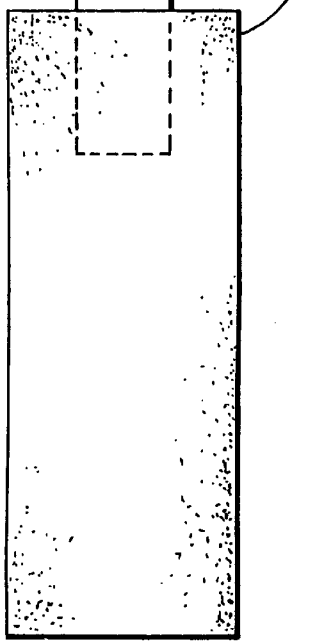
FIG. 1 illustrates schematically a stage in the formation of an electrode structure in accordance with a first embodiment of the invention.

Referring firstly to FIG. 1, the electrode structure incorporates a tungsten rod 1. Around the rod 1 there is provided a block 3 of tungsten powder.

The rod 1 is dimensioned to have a sufficient diameter to provide the arc seating. In the example shown the diameter of the rod is 3.2 mm, with the diameter of the tungsten block being 7.95 mm.

The electrode structure is formed by inserting the rod 1 into a press tool (not shown) and pressing the block 3 of tungsten powder around the rod 1. The structure is then sintered at a high temperature, typically between 1000° and 1800° C. in, for example an $H_2$ atmosphere, to create a fused integral structure of typically 60% to 80% density, with the porous sintered material forming the block 3 becoming intimately bonded to the rod 1. Small amounts of alloying material, such as nickel, cobalt or iron may be added to aid bonding.

The required shape for the block 3 in the electrode structure can be formed either within the press, or by removing the block from the press prior to sintering and performing simple machining while the powder is still friable. Thus, the difficulty and cost of machining the electrode structure may be substantially reduced.

It will be appreciated that the granular nature of the sintered block 3 will provide a large surface area, thus aiding radiative cooling of the electrode when used in a sealed arc lamp.

Figure 3:
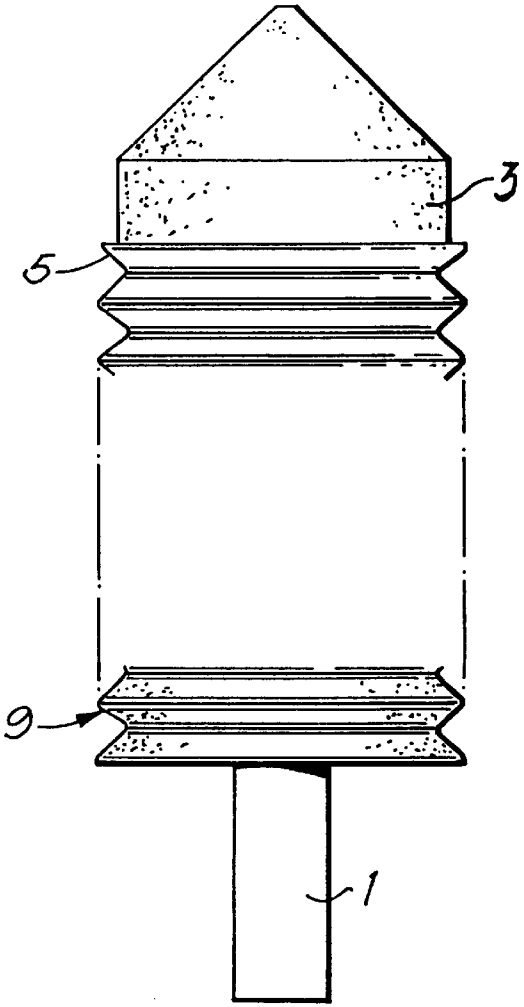
FIG. 3 illustrates schematically a further stage in the formation of the electrode structure of FIG. 2.
Figure 2:
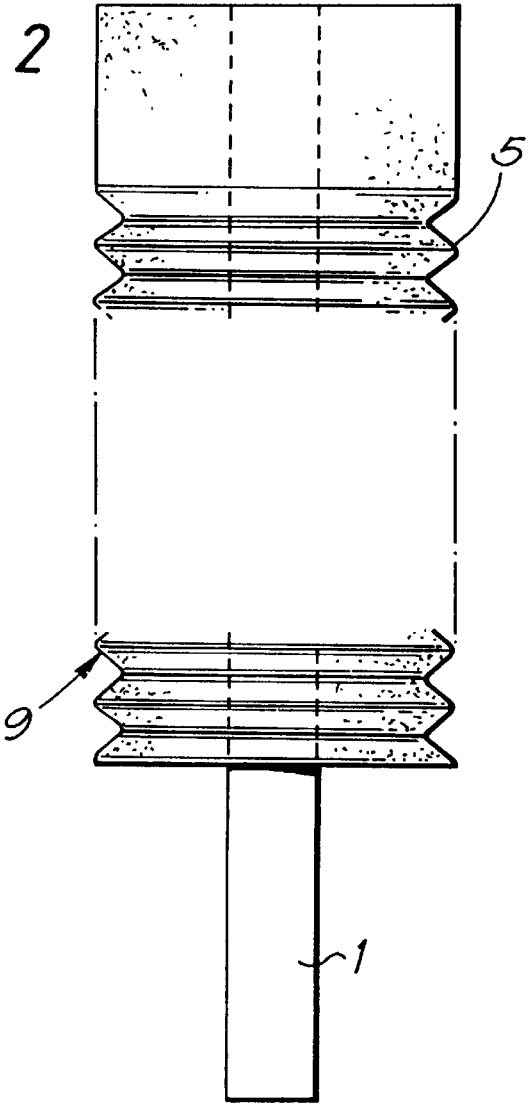
FIG. 2 illustrates schematically a stage in the formation of an electrode structure in accordance with a second embodiment of the invention.

The surface area of the electrode may be further increased by shaping the block so as to have surface grooves 5 as shown in FIGS. 2 and 3 or other surface formations. Such surface formations will be well known to those skilled in the art of electrode structures.

The tungsten rod 1 may be a short insert as indicated in FIG. 1. Alternatively the tungsten rod 1 may run the length of the block as indicated in FIGS. 2 and 3 dependent on the particular application of the electrode structure.

The face of the electrode structure which will receive the arc loading in the arc lamp will generally be shaped, for example to a point 7 as indicated in FIG. 3.

In order to decrease the work function of the electrode and thereby facilitate ignition of the arc, the core 1 may include thorium, a typical composition being 98% tungsten and 2% thorium oxide. Other dopants including lanthanum, hafnium, cerium or their oxides are possible.

In order to increase further the thermal emissivity of the block 3, the block 3 may be formed from tungsten carbide powder thereby increasing heat emissivity. Alternatively or additionally, particularly if the block 3 is made of tungsten powder, the block 3 can subsequently be carburised to form a dark, highly emissive carbon rich layer indicated as 9 in FIGS. 2 and 3 whilst still retaining the benefits of a porous structure.

Alternatively, or additionally, the thermal emissivity of the electrode structure can be improved by washing the block 3 with a suspension of a thermally emissive black powder such as manganese oxide or tungsten carbide so as to lodge grains of the thermally emissive powder in the body of the block 3. A Similar approach can be used to lodge thorium oxide into the surface of the block 3 so as to pre-ionize the gas in the lamp containing the electrode structure prior to ignition.

A further method to achieve a high thermal emissivity surface is to press a shell of, for example, tungsten carbide around a body of tungsten powder and sinter the assembly, thus combining the higher thermal conductivity of a tungsten body with the high surface emissivity of tungsten carbide. An example of such an arrangement is illustrated in FIG. 4.

Figure 4:
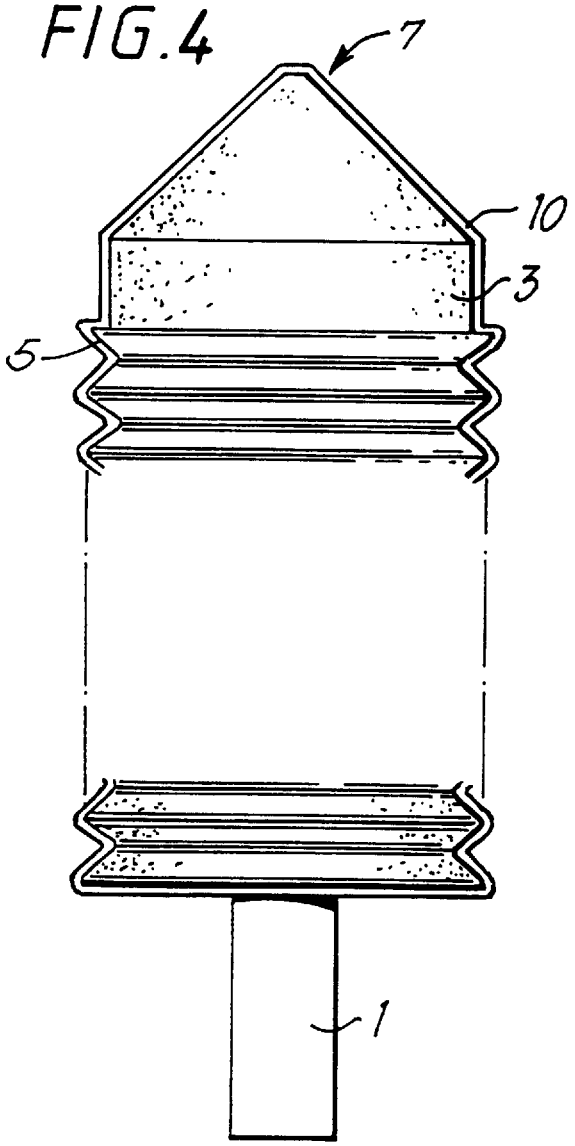
FIG. 4 ilustrates an adaptation of the electrode structure of FIG. 2.

As can be seen from FIG. 4, the electrode structure shown in FIG. 3 is now coated with a shell of tungsten carbide 10. A typical thickness for the tungsten carbide shell is 0.5 mm.

The thermal conductivity of the electrode structure may be increased by impregnating the porous block 3 with a material having high thermal conductivity. The high thermal conductivity material may be mixed with the tungsten powder forming the block 3 prior to pressing, or infiltrated into the porous matrix after sintering. Thus the block 3 may consist of tungsten copper, typically in the ratio 80:20. A further example of a composition for the block is tungsten carbide and copper in the ratio 67:33 this composition also increasing the thermal emissivity of the block 3. Composite materials with silver or braze alloys, for example copper/silver eutectic in place of copper can also be used. The shell coating 10 shown in FIG. 4 may, of course, also be chosen to increase the thermal conductivity of the electrode structure.

In order to maintain the large surface area granular structure of the block 3, and the high thermal emissivity of the tungsten carbide surface where this is used to form the block or as a shell, the block 3 may then be etched in dilute acid, for example dilute nitric acid, in order to expose the surface of the block 3. In use of such an impregnated electrode structure however, the electrode structure must be kept relatively cool in order to prevent evaporation or migration of the impregnating material. Such cool running is however also beneficial to the life of a lamp with such electrodes and may (at least in part) be achieved by the methods described here.

Where the block 3 has been impregnated with a thermally conductive material, the surface tungsten may be removed chemically to leave a surface of the impregnated metal suitable for brazing. Where the block 3 has been impregnated with a metal or alloy suitable for brazing, this will avoid the need for additional braze metal during the subsequent brazing process thus facilitating assembly of the arc lamp and avoiding expensive braze placements.

Figure 5:
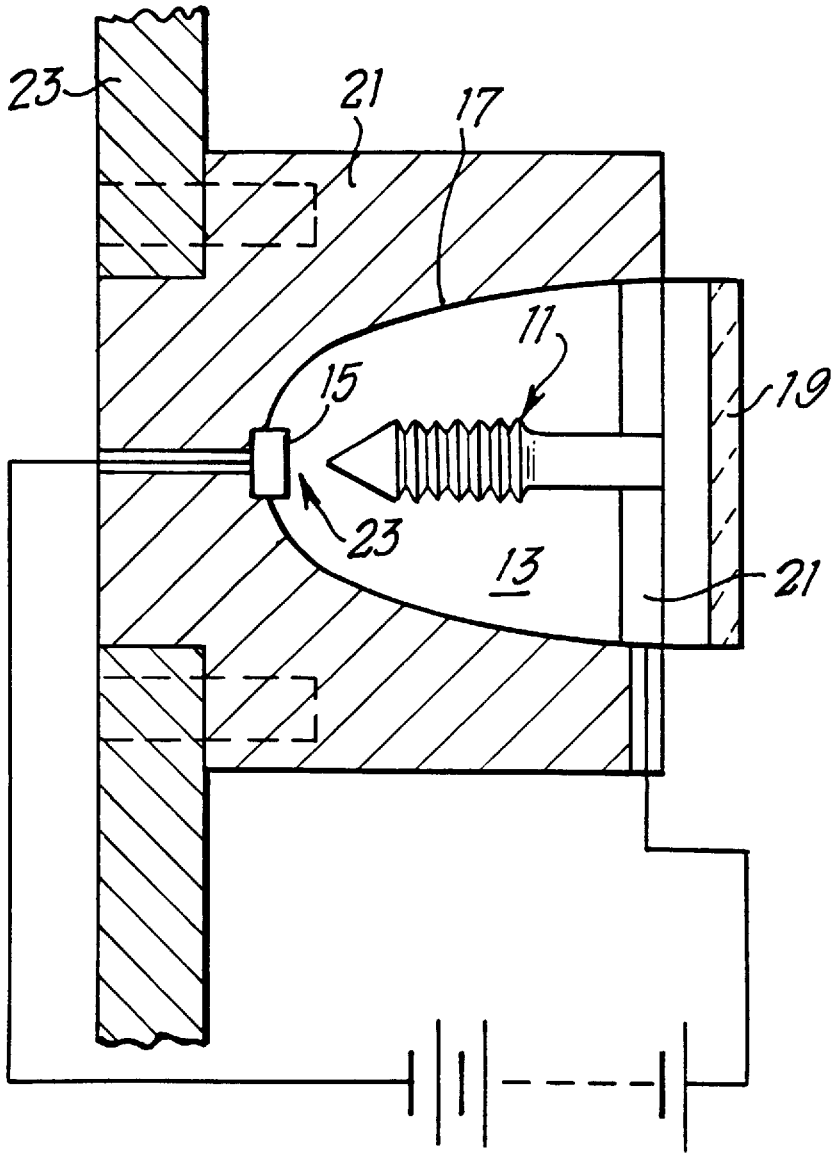
FIG. 5 is a schematic illustration of an arc lamp incorporating an electrode structure in accordance with an embodiment of the invention.

One example of an arc lamp which may include an electrode structure in accordance with the invention is described in our copending International patent application no. W093/26034 (the contents of which are incorporated herein by reference). Such an arrangement is illustrated in FIG. 5 in which an electrode of the form illustrated in FIG. 3 is used as a cathode 11 which is supported in a gas filled enclosure 13 so as to oppose an anode 15. The enclosure 13 is defined by a parabolic reflector 17 which is sealed by a light emitting window 19. The enclosure 13 typically contains xenon. The anode 15 is mounted in a heat conductive mounting 21 which is in turn mounted on a heat sink 23. The cathode 11 is suspended in the enclosure 13 by a support structure 21 which must be relatively thin so as not to obscure light emitted from the lamp and thus cannot be used to direct heat away from the cathode 11.

In use of the lamp, a voltage is applied between the cathode 11 and the anode 15 such that an arc is struck in the arc gap 23 defined between the cathode 11 and the anode 15. The arc gap 23 is positioned at the focal point of the parabolic reflector 17 such that a substantially parallel beam of light is directed out through the window 19.

The arc lamp shown in FIG. 5 is designed to operate at very high power levels at high efficiency. It will be seen that by use of an electrode structure in accordance with the invention, the large surface area of the cathode 11 produced by the sintered surface provides a large surface area aiding radiative cooling of the cathode 11 within the enclosure 13. Furthermore, thorium included in or on the cathode 11 as discussed in relation to FIGS. 2 and 3 facilitates ignition of the arc.

It will be appreciated that a method in accordance with the invention may be used to produce structures other than electrode structures. Furthermore, the powder which is used to form the sintered powder block may be an electrically insulating powder, for example a ceramic or oxide powder.

It will be appreciated that whilst the rod suitably comprises tungsten, any other suitable high melting point electrically conductive material, in particular other refractory metals or alloys of refractory metals may be used. One possible suitable refractory metal is molybdenum, particularly if the electrode in use has suitable cooling means.

I claim:

1. An electrode structure comprising:

a rod comprising refractory metal, part of which forms the arc seat of the electrode, the rod being at least partially surrounded by a sintered powder block, wherein the sintered block is impregnated with a material having a greater thermal conductivity than said powder.

2. A structure according to claim 1, in which the refractory metal is tungsten.

3. An electrode structure according to claim 2, wherein said powder comprises tungsten or tungsten carbide.

4. An electrode structure according to claim 2, wherein said block comprises a mixture of tungsten powder and copper powder.

5. An electrode according to claim 4, wherein said powder comprises between 60% to 80% tungsten and 40% to 20% copper.

6. A structure according to claim 1, in which the refractory metal is molybdenum.

7. An electrode structure according to claim 1, wherein said greater thermal conductivity material is a brazable material.

8. An electrode structure according to claim 7, in which said greater thermal conductivity material is silver.

9. An electrode structure according to claim 7, in which said greater thermal conductivity material is copper.

10. An electrode structure according to claim 1, wherein said block is etched so as to expose the sintered material.

11. An electrode structure according to claim 1, wherein the pores of said block are in-filled with an ignition enhancement material.

12. An electrode structure according to claim 11, wherein said ignition enhancement material is thorium oxide.

13. An electrode structure according to claim 1, wherein the sintered block includes pores, at least some of said pores being in-filled with grains of a thermally emissive material.

14. An electrode structure according to claim 13, wherein said thermally emissive material is manganese oxide or tungsten carbide.

15. An arc lamp including an electrode structure according to claim 1.

* * * * *

UNITED STATES PATENT AND TRADEMARK OFFICE

CERTIFICATE OF CORRECTION

PATENT NO. : 5,874,805

DATED : Feb 23, 1999

INVENTOR(S) : Martin Kavanagh

It is certified that error appears in the above-identified patent and that said Letters Patent is hereby corrected as shown below:

In column 4, lines 52-53, delete "wherein the pores of said block are" and insert therefor --wherein the sintered block includes pores, said pores of said block being--.

Signed and Sealed this

Twenty-first Day of December, 1999

*Attest:*

Q. TODD DICKINSON

*Attesting Officer*

*Acting Commissioner of Patents and Trademarks*